US007671269B1

(12) United States Patent
Krueger et al.

(10) Patent No.: US 7,671,269 B1
(45) Date of Patent: Mar. 2, 2010

(54) METHODS AND SYSTEMS FOR GRAPHICAL ACTUATION OF A VELOCITY AND DIRECTIONALLY SENSITIVE SOUND GENERATION APPLICATION

(75) Inventors: George Krueger, Oakland, CA (US); Dean Burris, Kensington, CA (US); Stephen Dmytriw, Oakland, CA (US)

(73) Assignee: LeapFrog Enterprises, Emeryville, CA (US)

( * ) Notice: Subject to any disclaimer, the term of this patent is extended or adjusted under 35 U.S.C. 154(b) by 58 days.

(21) Appl. No.: 11/803,587

(22) Filed: May 14, 2007

(51) Int. Cl.
*G10H 3/06* (2006.01)

(52) U.S. Cl. ..... 84/724; 84/600; 84/626; 84/723; 84/737

(58) Field of Classification Search ..... None
See application file for complete search history.

(56) References Cited

U.S. PATENT DOCUMENTS 4,731,859 A 3/1988 Holter et al.
6,555,737 B2 4/2003 Miyaki et al.
6,832,724 B2 * 12/2004 Yavid et al. ..... 235/454
2002/0125324 A1 * 9/2002 Yavid et al. ..... 235/462.45
2007/0163427 A1 7/2007 Rigopulos et al.
2007/0180978 A1 8/2007 Ozaki et al.
2008/0062122 A1 * 3/2008 Rosenberg et al. ..... 345/156
2008/0113797 A1 5/2008 Egozy

FOREIGN PATENT DOCUMENTS

JP 59049669 1/1999
JP 61169972 1/1999

* cited by examiner

*Primary Examiner*—Marlon T Fletcher

(57) ABSTRACT

Methods and systems for graphical actuation of a velocity and directionally sensitive sound generation application are disclosed. An identifier of a graphical element or elements that are traversed is received wherein the graphical element or elements are located on a coded surface. In one embodiment, the traversal has a velocity and a direction. Moreover, the traversal can be performed with an optical pen on a graphical representation of a sound generation system. The velocity and the direction of the traversal are determined and an identifier of the velocity and the direction of the traversal is used to actuate a directionally sensitive sound generation application.

7 Claims, 7 Drawing Sheets

600

METHODS AND SYSTEMS FOR GRAPHICAL ACTUATION OF A VELOCITY AND DIRECTIONALLY SENSITIVE SOUND GENERATION APPLICATION

BACKGROUND

A turntable is a circular rotating platform of a record player. Turntables can be used in a skillful manner by DJs to mix and scratch records. Many professional CD players now have been provided with the same capability. Such devices can be velocity and directionally sensitive in that they produce sounds that are based on the direction and the velocity of turntable movement.

One shortcoming of conventional turntables and other sound producing systems is that they are packaged in conventional modules and can occupy significant space. Accordingly, the use of these devices outside of their traditional workspaces is not feasible. This represents a significant shortcoming as musicians and other users of these instruments are precluded from using them in non-traditional venues where such use might be advantageous.

Some software based systems such as garage band TM allow the actuation of certain sounds via a computer system. These systems provide a computer generated graphical interface that can be employed to control the generation of sounds. These operations can be controlled by conventional point and click technologies. However, the control offered by such conventional software based systems provide a very limited range of sound actuation control options in the face of the rapidly changing needs of consumers.

SUMMARY

A system that enables the control of a velocity and directionally sensitive sound generating application using non-traditional media (e.g., paper) and mechanisms would be advantageous. Embodiments of the present invention provide such a system, as well as methods and applications that can be implemented using such a system.

In one embodiment, a system for graphical control of a velocity and directionally sensitive sound generation application is disclosed that enables the control of an optical pen based velocity and directionally sensitive sound generation application from graphical elements that are placed on (drawn, printed etc.) an encoded surface. In one embodiment, the graphical elements depict a turntable. In other embodiments, the graphical elements can depict other velocity sensitive and directionally sensitive sound generating instruments (violin, cello, trombone etc.). An optical pen user can use the optical pen to traverse one or more graphical elements that are a part of the graphically depicted device or instrument on the encoded surface that corresponds to particular sounds. For example, a user can generate a scratch sound by drawing across the turntable. Moreover, the pitch, volume, and other characteristics of the scratch sound produced by the pen device can be generated, for example, in accordance with the direction of the drawing.

In one embodiment, methods and systems for graphical actuation of a velocity and directionally sensitive sound generation application are disclosed. An identifier of a graphical element or elements that are traversed is received wherein the graphical element or elements are located on a coded surface. In one embodiment, the traversal has a velocity and a direction. Moreover, the traversal can be performed with an optical pen on a graphical representation of a sound generation system. The velocity and the direction of the traversal are determined and used to actuate a sound generation application.

In one embodiment, using the optical pen, a region is defined on an item of encoded media (e.g., on a piece of encoded paper). A velocity sensitive and directionally sensitive sound is then associated with that region. When the region is subsequently scanned, the velocity sensitive and directionally sensitive sound is produced.

The content of a region may be handwritten by a user, or it may be preprinted. Although the velocity sensitive and directionally sensitive sound associated with a region may be selected to evoke the content of the region, the sound can be independent of the region's content (other than the encoded pattern of markings within the region). Thus, the content of a region can be changed without changing the sound associated with the region, or the sound can be changed without changing the content.

As mentioned above, once a sound is associated with a region, that sound can be generated or played back when the region is subsequently scanned by the device.

In summary, according to embodiments of the present invention, a user can interact with a device (e.g., an optical pen) and an input media (e.g., encoded paper) to graphically control the actuation of velocity sensitive and directionally sensitive sounds. These and other objects and advantages of the present invention will be recognized by one skilled in the art after having read the following detailed description, which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

In the following detailed description of the present invention, numerous specific details are set forth in order to provide a thorough understanding of the present invention. However, it will be recognized by one skilled in the art that the present invention may be practiced without these specific details or with equivalents thereof. In other instances, well-known methods, procedures, components, and circuits have not been described in detail as not to unnecessarily obscure aspects of the present invention.

Some portions of the detailed descriptions, which follow, are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "sensing" or "scanning" or "storing" or "defining" or "associating" or "receiving" or "selecting" or "generating" or "creating" or "decoding" or "invoking" or "accessing" or "retrieving" or "identifying" or "prompting" or the like, refer to the actions and processes of a computer system (e.g., flowchart 600 of FIG. 6), or similar electronic computing device, that manipulates and transforms data represented as physical (electronic) quantities within the computer system's registers and memories into other data similarly represented as physical quantities within the computer system memories or registers or other such information storage, transmission or display devices.

Figure 1:
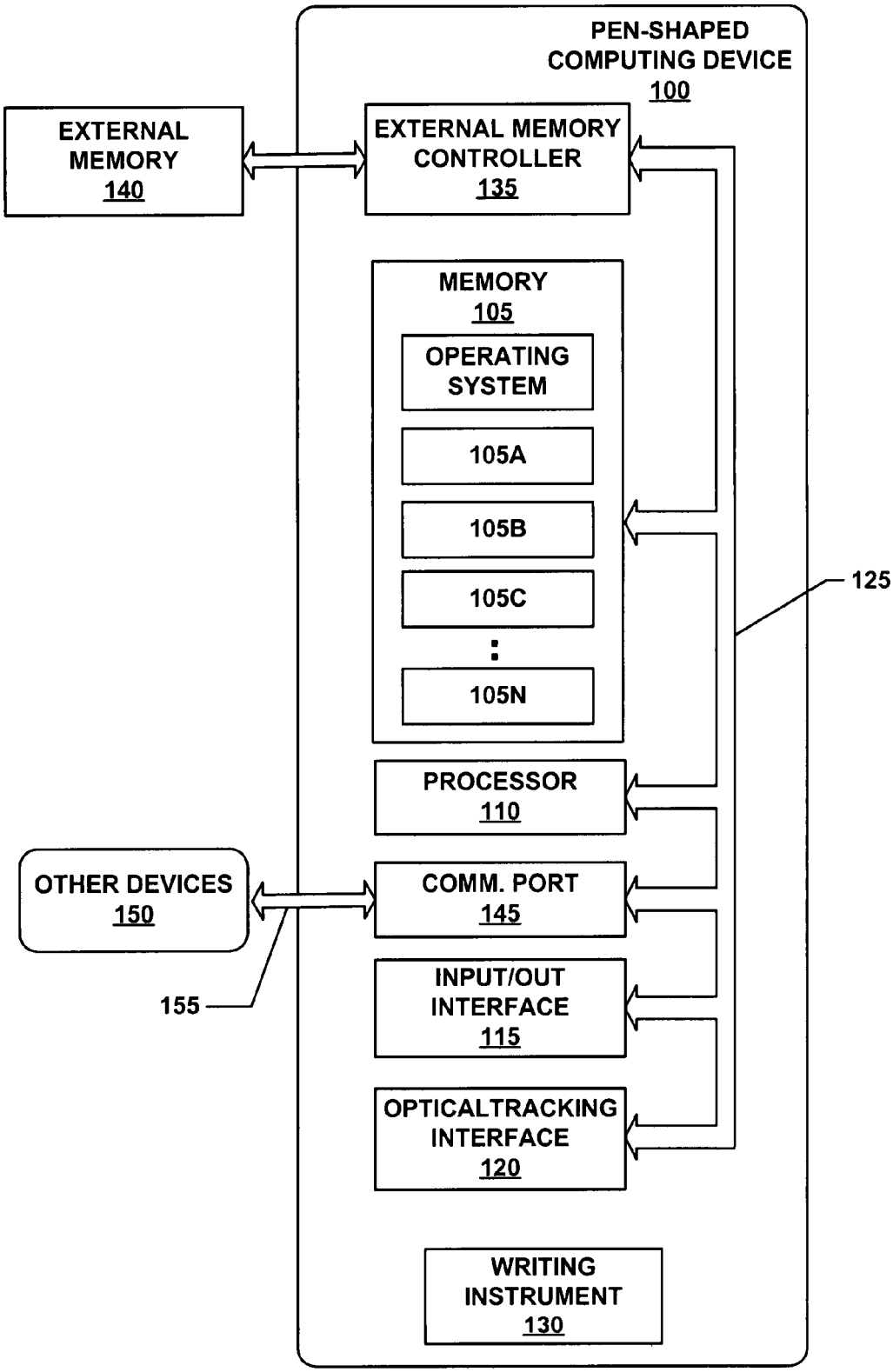
FIG. 1 is a block diagram of an optical device with which a system for graphical actuation of a velocity and directionally sensitive sound generating application can be used according to one embodiment of the present invention.

Exemplary Computer System Environment of System for Graphical Actuation of a Velocity and Directionally Sensitive Application According to Embodiments FIG. 1 is a block diagram of a computing device 100 upon which embodiments of the present invention can be implemented. In general, device 100 may be referred to as a pen-shaped computer system or an optical device, or more specifically as an optical reader, optical pen or digital pen. In general, device 100 may have a form factor similar to a pen, stylus or the like.

Devices such as optical readers or optical pens emit light that can be reflected off of a surface for receipt by a detector or imager. As the device is moved relative to the surface, successive images can be rapidly captured. By analyzing the images, the movement of the optical device relative to the surface can be tracked.

According to embodiments of the present invention, device 100 can be used with a sheet of "digital paper" on which a pattern of markings—specifically, very small dots—are printed. Digital paper may also be referred to herein as encoded media or encoded paper. In one embodiment, the dots can be printed on paper in a proprietary pattern with a nominal spacing of about 0.3 millimeters (0.01 inches). In one such embodiment, the pattern consists of 669,845,157,115,773,458,169 dots, and can encompass an area exceeding 4.6 million square kilometers, corresponding to about 73 trillion letter-size pages. This "pattern space" is subdivided into regions that are licensed to vendors (service providers)—where each region is unique from other regions. In this manner, service providers are licensed pages of the pattern that are exclusively for their use. Different parts of the pattern can be assigned different functions.

In one embodiment, in operation, an optical pen such as device 100 can take snapshots of the surface of the aforementioned digital paper. By interpreting the positions of the dots captured in each snapshot, device 100 can precisely determine its position on a page of the digital paper in two dimensions. That is, device 100 can determine an x-coordinate and a y-coordinate position of the device relative to the page (based on a Cartesian coordinate system). The pattern of dots allows the dynamic position information coming from the optical sensor/detector in device 100 to be translated into signals that are indexed to instructions or commands that can be executed by a processor in the device.

In the FIG. 1 example, device 100 includes system memory 105, processor 110, input/output interface 115, optical tracking interface 120, one or more buses 125 and a writing instrument 130 that projects from the device housing. System memory 105, processor 110, input/output interface 115 and optical tracking interface 120 are communicatively coupled to each other by the one or more buses 125.

Memory 105 can include one or more types of computer-readable media, such as static or dynamic read only memory (ROM), random access memory (RAM), flash memory, magnetic disk, optical disk and/or the like. Memory 105 can be used to store one or more sets of instructions and data that, when executed by the processor 110, cause the device 100 to perform the functions described herein. In one embodiment, one such set of instructions can include a system for associating a region on a surface with a sound 105A. In the FIG. 1 embodiment, memory also includes sets of instructions that encompass a velocity and directionally sensitive sound generation application 105B and a system for graphical control of a velocity and directionally sensitive sound generation application 105N. In one embodiment, 105A, 105B and 105N can be integrated. In other embodiments, 105A, 105B and 105N can be separated (as shown in FIG. 1) but can be designed to operate cooperatively.

Device 100 can further include an external memory controller 135 for removably coupling an external memory 140 to the one or more buses 125. Device 100 can also include one or more communication ports 145 communicatively coupled to the one or more buses 125. The one or more communication ports can be used to communicatively couple device 100 to one or more other devices 150. Device 110 may be communicatively coupled to other devices 150 by either wired and/or a wireless communication link 155. Furthermore, the communication link may be a point-to-point connection and/or a network connection.

Input/output interface 115 can include one or more electromechanical switches operable to receive commands and/or data from a user. Input/output interface 115 can also include one or more audio devices, such as a speaker, a microphone, and/or one or more audio jacks for removably coupling an earphone, headphone, external speaker and/or external microphone. The audio device is operable to output audio content and information and/or receiving audio content, information and/or instructions from a user. Input/output interface 115 can include video devices, such as a liquid crystal display (LCD) for displaying alphanumeric and/or graphical information and/or a touch screen display for displaying and/or receiving alphanumeric and/or graphical information.

Optical tracking interface 120 includes a light source or optical emitter and a light sensor or optical detector. The optical emitter can be a light emitting diode (LED) and the optical detector can be a charge coupled device (CCD) or complementary metal-oxide semiconductor (CMOS) imager array, for example. The optical emitter is used to illuminate a surface of a media or a portion thereof, and light reflected from the surface is received at the optical detector.

Figure 2:
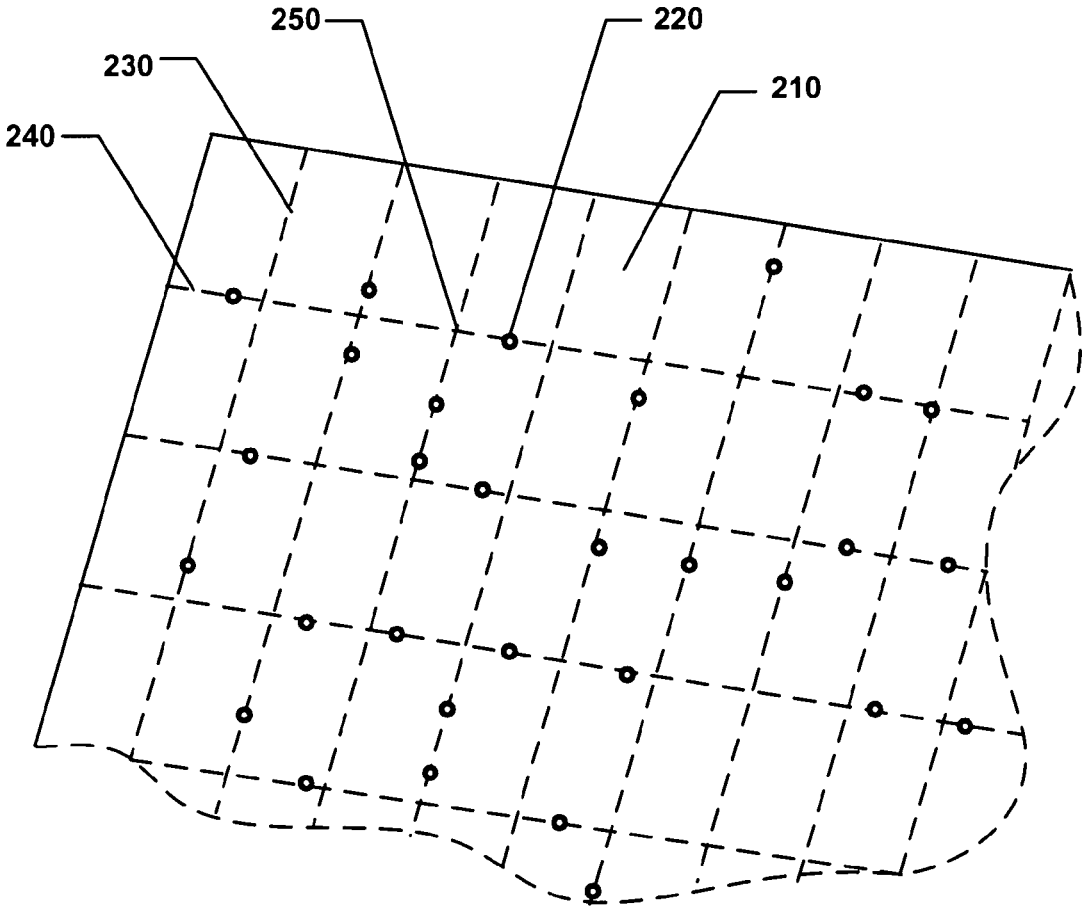
FIG. 2 illustrates a portion of an item of encoded media with which a system for graphical actuation a velocity and directionally sensitive sound generating application can be used according to one embodiment of the present invention.

The surface of the media can contain a pattern detectable by the optical tracking interface 120. Referring now to FIG. 2, shown is an example of a type of encoded media 210, which can be used in embodiments of the present invention. Media 210 can include a sheet of paper, although surfaces consisting of materials other than, or in addition to, paper can be used. Media 210 can be a flat panel display screen (e.g., an LCD) or electronic paper (e.g., reconfigurable paper that utilizes electronic ink). Also, media 210 may or may not be flat. For example, media 210 can be embodied in the surface of a globe.

Media 210 can be smaller or larger than a conventional (e.g., 8.5×11-inch) page of paper. In general, media 210 can be any type of surface upon which markings (e.g., letters, numbers, symbols, etc.) can be printed or otherwise deposited, or media 210 can be a type of surface wherein a characteristic of the surface changes in response to action on the surface by device 100.

In one embodiment, the media 210 is provided with a coding pattern in the form of optically readable position code that consists of a pattern of dots. As the writing instrument 130 and the optical tracking interface 120 move together relative to the surface, successive images are captured. The optical tracking interface 120 (specifically, the optical detector) can take snapshots of the surface at a rate of 100 times or more per second. By analyzing the images, position on the surface and movement relative to the surface of the media can be tracked.

In one embodiment, the optical detector fits the dots to a reference system in the form of a raster with raster lines 230 and 240 that intersect at raster points 250. Each of the dots 220 is associated with a raster point. For example, the dot 220 is associated with raster point 250. For the dots in an image, the displacement of a dot 220 from the raster point 250 associated with the dot 220 is determined. Using these displacements, the pattern in the image is compared to patterns in the reference system. Each pattern in the reference system is associated with a particular location on the surface. Thus, by matching the pattern in the image with a pattern in the reference system, the position of the device 100 (FIG. 1) relative to the surface can be determined.

With reference to FIGS. 1 and 2, by interpreting the positions of the dots 220 captured in each snapshot, the operating system and/or one or more applications executing on the device 100 can precisely determine the position of the device 100 in two dimensions. As the writing instrument and the optical detector move together relative to the surface, the direction and distance of each movement can be determined from position data.

In addition, different parts of the pattern of markings can be assigned different functions, and software programs and applications may assign functionality to the various patterns of dots within a respective region. Furthermore, by placing the optical detector in a particular position on the surface and performing some type of actuating event, a specific instruction, command, data or the like associated with the position can be entered and/or executed. For example, the writing instrument 130 can be mechanically coupled to an electromechanical switch of the input/output interface 115. Therefore, in one embodiment, for example, double-tapping substantially the same position can cause a command assigned to the particular position to be executed.

The writing instrument 130 of FIG. 1 can be, for example, a pen, pencil, marker or the like, and may or may not be retractable. In one or more instances, a user can use writing instrument 130 to make strokes on the surface, including letters, numbers, symbols, figures and the like. These user-produced strokes can be captured (e.g., imaged and/or tracked) and interpreted by the device 100 according to their position on the surface on the encoded media. The position of the strokes can be determined using the pattern of dots on the surface of the encoded media as discussed above.

A user, in one embodiment, can use writing instrument 130 to create a character, for example, an "M" at a given position on the encoded media. In this embodiment, the user may or may not create the character in response to a prompt from computing device 100. In one embodiment, when the user creates the character, device 100 records the pattern of dots that are uniquely present at the position where the character is created. Moreover, computing device 100 associates the pattern of dots with the character just captured. When computing device 100 is subsequently positioned over the "M," the computing device 100 recognizes the particular pattern of dots associated therewith and recognizes the position as being associated with "M." Accordingly, computing device 100 actually recognizes the presence of the character using the pattern of markings at the position where the character is located, rather than by recognizing the character itself.

In another embodiment, strokes can instead be interpreted by device 100 using optical character recognition (OCR) techniques that recognize handwritten characters. In one such embodiment, computing device 100 analyzes the pattern of dots that are uniquely present at the position where the character is created (e.g., stroke data). That is, as each portion (stroke) of the character "M" is made, the pattern of dots traversed by the writing instrument 130 of device 100 are recorded and stored as stroke data. Using a character recognition application, the stroke data captured by analyzing the pattern of dots can be read and translated by device 100 into the character "M." This capability can be useful for applications such as, but not limited to, text-to-speech and phoneme-to-speech synthesis.

In another embodiment, a character is associated with a particular command. For example, a user can write a character composed of a circled "M" that identifies a particular command, and can invoke that command repeatedly by simply positioning the optical detector over the written character. In other words, the user does not have to write the character for a command each time the command is to be invoked; instead, the user can write the character for a command one time and invoke the command repeatedly using the same written character.

In another embodiment, the encoded paper can be preprinted with one or more graphics at various locations in the pattern of dots. For example, the graphic can be a preprinted graphical representation of a button. The graphics lies over a pattern of dots that is unique to the position of the graphic. By placing the optical detector over the graphic, the pattern of dots underlying the graphics are read (e.g., scanned) and interpreted, and a command, instruction, function or the like associated with that pattern of dots is implemented by device 100. Furthermore, some sort of actuating movement may be performed using the device 100 in order to indicate that the user intends to invoke the command, instruction, function or the like associated with the graphic.

In yet another embodiment, a user can identify information by placing the optical detector of the device 100 over two or more locations. For example, the user can place the optical detector over a first location and then over a second location to specify a bounded region (e.g., a box having corners corresponding to the first and second locations). In this example, the first and second locations identify the information lying within the bounded region. In another example, the user may draw a box or other shape around the desired region to identify the information. The content within the region can be present before the region is selected, or the content can be added after the bounded region is specified.

Additional information is provided by the following patents and patent applications, herein incorporated by reference in their entirety for all purposes: U.S. Pat. No. 6,502,756; U.S. patent application Ser. No. 10/179,966 filed on Jun. 26, 2002; WO 01/95559; WO 01/71473; WO 01/75723; WO 01/26032; WO 01/75780; WO 01/01670; WO 01/75773; WO 01/71475; WO 01/73983; and WO 01/16691. See also Patent Application No. 60/456,053 filed on Mar. 18, 2003, and patent application Ser. No. 10/803,803 filed on Mar. 17, 2004, both of which are incorporated by reference in their entirety for all purposes.

Exemplary Encoded Media

Figure 3:
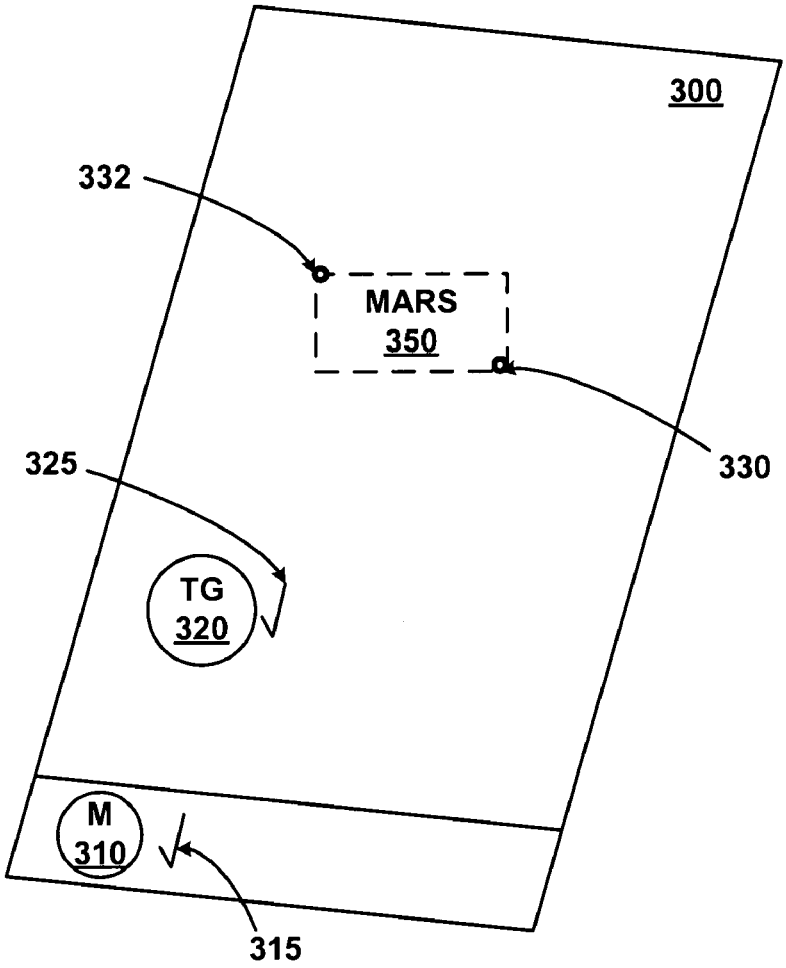
FIG. 3 illustrates an example of an item of encoded media with added content according to one embodiment of the present invention.

FIG. 3 illustrates an example of an item of encoded media 300 according to one embodiment of the present invention. In FIG. 3, media 300 is encoded with a pattern of markings (e.g., dots) that can be decoded to identify unique positions on its surface, as discussed above.

Referring to FIG. 3, graphic element 310 is preprinted on the surface of media 300. A graphic element can be referred to as an icon. In one embodiment, there can be more than one preprinted element on media 300. Associated with element 310 is a particular function, instruction, command or the like. As described previously herein, underlying the region covered by element 310 is a pattern of markings (e.g., dots) unique to that region. In one embodiment, a second element (e.g., a checkmark 315) is associated with element 310. Checkmark 315 is generally positioned in proximity to element 310 to suggest a relationship between the two graphic elements.

By placing the optical detector of device 100 (FIG. 1) anywhere within the region encompassed by element 310, a portion of the underlying pattern of markings sufficient to identify that region can be sensed and decoded, and the associated function, etc., can be invoked. In general, device 100 can simply be brought into contact with any portion of the region encompassed by element 310 (e.g., element 310 is tapped with device 100) in order to invoke a corresponding function, etc. Alternatively, the function, etc., associated with element 310 can be invoked using checkmark 315 (e.g., by tracing, tapping or otherwise sensing checkmark 315), by double-tapping element 310, or by some other type of actuating movement.

In one embodiment, there can be multiple levels of functions, etc., associated with a single graphic element such as element 310. For example, element 310 can be associated with a list of functions, etc.—each time device 100 scans (e.g., taps) element 310, the name of a function, command, etc., in the list is presented to the user. In one embodiment, the names in the list can be vocalized or otherwise made audible to the user. To select a particular function, etc., from the list, an actuating movement of device 100 can be made. In one embodiment, the actuating movement includes tracing, tapping, or otherwise sensing the checkmark 315 in proximity to element 310.

In the FIG. 3 embodiment, a user can also activate a particular function, application, command, instruction or the like by using device 100 to draw elements such as graphic element 320 and checkmark 325 on the surface of media 300. In other words, a user can create handwritten graphic elements that function in the same way as the preprinted ones. A checkmark 325 hand drawn in proximity to element 320 can be used as described above if there are multiple levels of commands, etc., associated with the element 320. The function, etc., associated with element 320 can be initially invoked by the mere act of drawing element 320, it can also be invoked using checkmark 325, by double-tapping element 320, or by some other type of actuating action.

A region 350 can be defined on the surface of media 300 by using device 100 to draw the boundaries of the region. Alternatively, a rectilinear region 350 can be defined by touching device 100 to the points 330 and 332 (in which case, lines delineating the region 350 are not visible to the user).

In the example of FIG. 3, the word "Mars" is handwritten by the user in region 350. The word "Mars" may be generally referred to herein as the content of region 350. That is, although region 350 also includes the pattern of markings described above in addition to the word "Mars," for simplicity of discussion the term "content" can be used herein to refer to the information in a region that is located there in addition to the pattern of markings associated with that region.

Importantly, the content of region 350 can be created either before or after region 350 is defined. That is, for example, a user can first write the word "Mars" on the surface of media 300 (using either device 100 of FIG. 1 or any type of writing utensil) and then use device 100 to define a region that encompasses that content. Alternately, the user can first define a region using device 100 and then write the word "Mars" within the boundaries of that region (the content can be added using either device 100 or any type of writing utensil).

Although content can be added, using either device 100 or another writing utensil, adding content using device 100 permits additional functionality. In one embodiment, as discussed above, stroke data can be captured by device 100 as the content is added. Device 100 can analyze the stroke data to in essence read the added content. Then, using text-to-speech synthesis (TTS) or phoneme-to-speech synthesis (PTS), the content can be subsequently verbalized.

For example, the word "Mars" can be written in region 350 using device 100. As the word is written, the stroke data is captured and analyzed, allowing device 100 to recognize the word as "Mars."

In one embodiment, stored on device 100 is a library of words along with associated vocalizations of those words. If the word "Mars" is in the library, device 100 can associate the stored vocalization of "Mars" with region 350 using TTS. If the word "Mars" is not in the library, device 100 can produce a vocal rendition of the word using PTS and associate the rendition with region 350. In either case, device 100 can then render (make audible) the word "Mars" when any portion of region 350 is subsequently sensed by device 100.

Figure 4A:
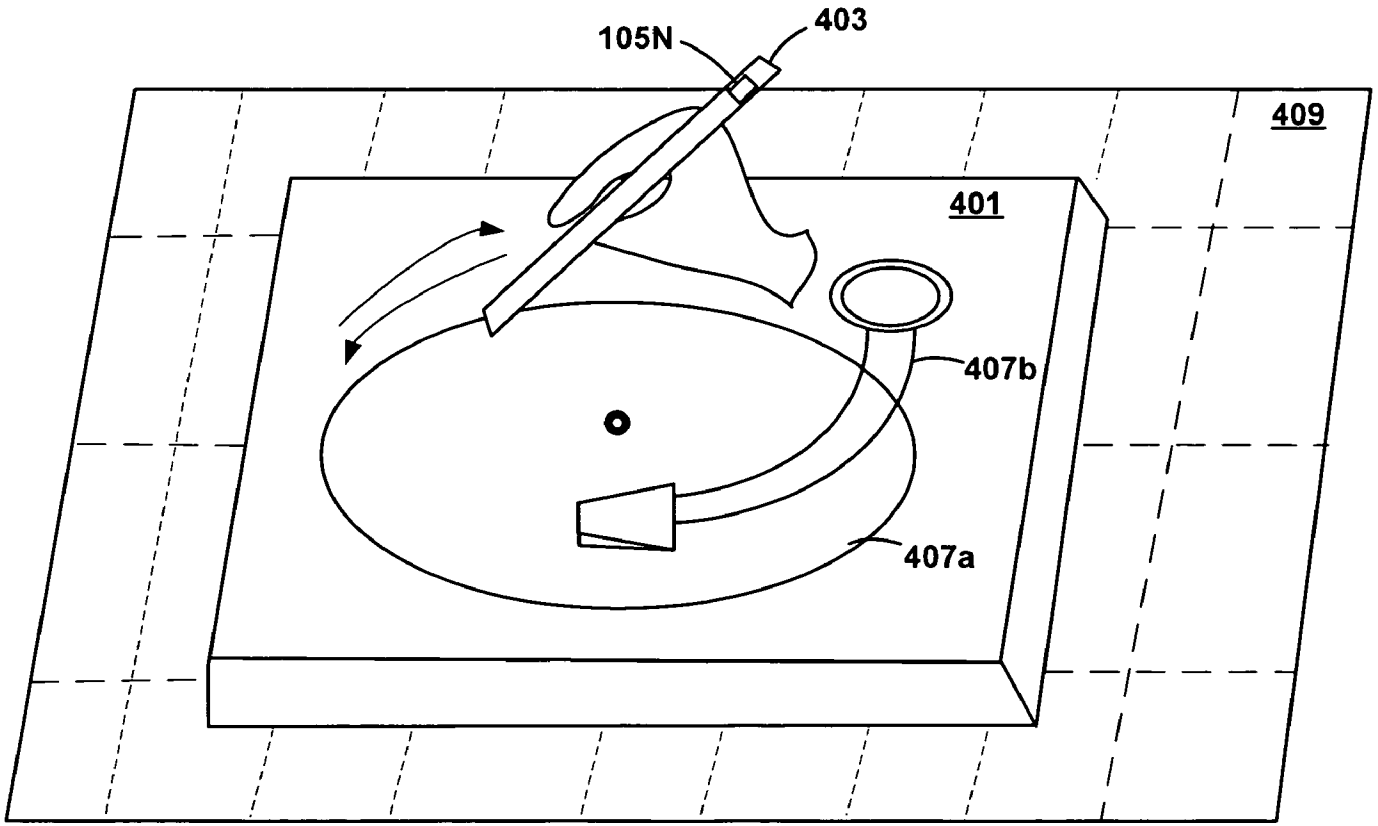
FIG. 4A shows an exemplary operating environment for a system for graphical actuation of a velocity and directionally sensitive sound generation application (SGVD) according to one embodiment of the present invention.

Exemplary Operating Environment of System for Graphical Actuation of a Velocity and Directionally Sensitive Sound Generation Application According to Embodiments FIG. 4A shows an exemplary operating environment for a system 105N for graphical actuation of a velocity and directionally sensitive sound generation application (SGVD) according to one embodiment of the present invention. FIG. 4A shows graphically depicted velocity and directionally sensitive sound system 401, optical pen 403, SGVD 105N, graphical elements 407*a*-407*b* and encoded media 409.

Referring to FIG. 4A, graphically depicted velocity and directionally sensitive sound generation system 401 facilitates the graphical control of a velocity and directionally sensitive application (e.g., 105B in FIG. 1) that is associated with optical pen 403. Graphically depicted sound generation system 401 can be drawn or printed on encoded media 409 (see encoded media described with reference to FIG. 2). Graphically depicted sound generation system 401 includes graphical element 407*a* and 407*b*.

In the FIG. 4A embodiment, graphical elements 407*a* and 407*b* can be associated with velocity and directionally sensitive sound generation application sounds. Importantly, graphical elements 407*a* and 407*b* when traversed by optical pen 403 can cause the actuation of sounds from an associated velocity and directionally sensitive sound generation application (e.g., 105B in FIG. 1).

In one embodiment, optical pen 403 can include an optical tracking interface (e.g., 120 in FIG. 1) that can take snapshots of the encoded media surface at a rate of 100 times or more per second. By analyzing the images, the position on the surface and the movement relative to the surface, of the optical pen 403, can be tracked and identified. Using this information the velocity and direction of movements of the optical pen by a user can be determined.

Graphical elements 407*a* and 407*b*, and regions within these elements, correspond to particular locations on encoded media 409 that can be correlated to the aforementioned velocity and directionally sensitive sound generation application sounds. The encoded media can be read, such as through use of an optical pen 403, to cause the graphical actuation of the correlated velocity and directionally sensitive sounds.

Optical pen 403 facilitates the actuation of sounds of an associated velocity and directionally sensitive sound generation application (e.g., 105B in FIG. 1). In one embodiment, optical pen 403 can be held by a user in a manner similar to the manner in which ordinary writing pens are held. In one embodiment, a user can move optical pen 403 along graphical elements 407*a* and 407*b* in order to control the generation of sounds generated by velocity and directionally sensitive sound generation application 105B. In one embodiment, optical pen 403 can include components similar to those included in device 100 described herein with reference to FIG. 1. For purposes of clarity and brevity these components will not be discussed again here.

SGVD 105N accesses identifiers of regions of a graphical element or elements, that are a part of the graphically depicted velocity and directionally sensitive sound generation device (e.g., turntable), that are traversed by optical pen 403. Moreover, SGVD 105N provides access to determinations of the velocity and direction of this traversal of graphical elements.

In one embodiment, SGVD 105N can implement an algorithm for graphical actuation of a velocity and directionally sensitive sound generation application. In one embodiment, SGVD 105N can be implemented in either hardware or software, or in a combination of both.

Operation

Figures 4A, 4B:
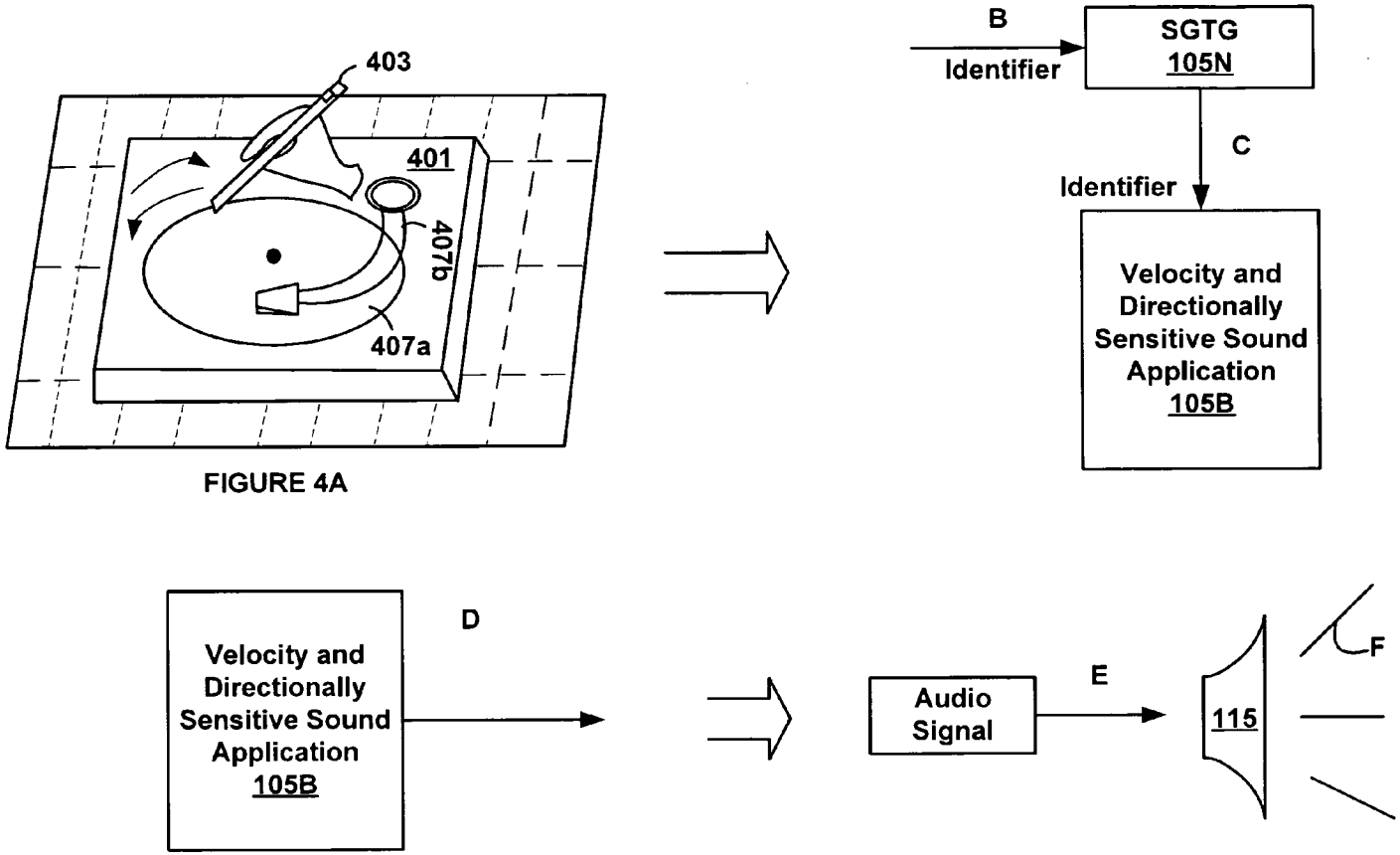
FIG. 4B illustrates the operation of SGVD according to one embodiment of the present invention.

FIG. 4B illustrates the operation of SGVD 105N according to one embodiment. FIG. 4B shows operations A through F. These operations including the order in which they are presented are only exemplary. In other embodiments, other operations in other orders can be included.

Referring to FIG. 4B, at A, a traversal made with respect to a graphical element or elements on a graphical representation of a velocity and directionally sensitive sound generating system is made. In the embodiment illustrated in FIG. 4A, regions of one or more graphical elements that represent portions of the aforementioned velocity and directionally sensitive sound generating system, can be traversed such as by a user using optical pen 403. The traversal of the regions of graphical element or elements generates identifiers of the graphical element or elements that have been traversed.

At B, based upon the traversal of graphical elements made at A by a user, a user traversal of a graphical element or elements is identified by SGVD 105N At C, identifiers of the traversed graphical element or elements are provided to the velocity and directionally sensitive sound generation application.

At D, an audio signal is produced by the directionally sensitive sound generation application.

At E, an audio output device receives the audio signal generated by the velocity and directionally sensitive sound generation application.

At F, a velocity and directionally sensitive sound is produced.

To summarize, at least one embodiment is directed to a velocity and directionally sensitive sound generation system. One embodiment is directed to the interaction processes facilitated by optical pen 403 in the actuation of a velocity and directionally sensitive sound generation application. The turntable can be pre-printed or user drawn. The sound generation application receives input from the user by sensing the direction and velocity of an actuation of the application via the graphical depiction of the turntable. For example, the user can generate a scratch sound by drawing across the turntable. Moreover, the pitch, volume, and other characteristics of the scratch sound produced by the pen device can be generated in accordance with, for example, the direction of the drawing (e.g., along the perimeter, across the width of the diameter, in a forward direction, in a backward direction, etc.). In other embodiments, other velocity and directionally sensitive instruments can be implemented (e.g., violin, cello, trombone, etc.).

Figure 5:
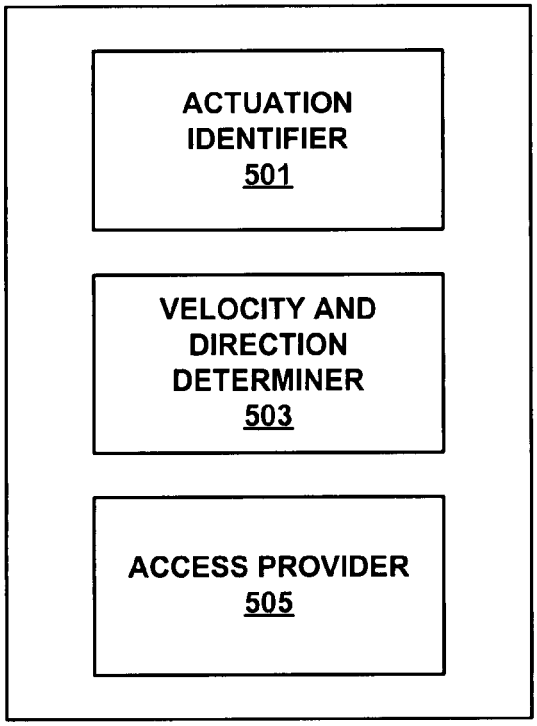
FIG. 5 shows components of a system for graphical actuation of a velocity and directionally sensitive sound generation system (SGVD) according to one embodiment of the present invention.

Components of System for Graphical Actuation of a Velocity and Directionally Sensitive Sound Generation Application According to Embodiments FIG. 5 shows components of a system 105N for graphical actuation of a velocity and directionally sensitive sound generation system (SGVD) according to one embodiment of the present invention. In one embodiment components of SGVD 105N implement an algorithm for graphical actuation of a velocity and directionally sensitive application. In the FIG. 5 embodiment, SGVD 105N includes actuation identifier 501, velocity and direction determiner 503, and access provider 505.

It should be appreciated that aforementioned components of SGVD 105N can be implemented in hardware or software or in a combination of both. In one embodiment, components and operations of SGVD 105N can be encompassed by components and operations of one or more computer programs. In another embodiment, components and operations of SGVD 105N can be separate from the aforementioned one or more computer programs but can operate cooperatively with components and operations thereof.

Referring to FIG. 5, actuation identifier 501 accesses an identifier of a graphical actuation. In one embodiment, the graphical actuation has a velocity and a direction (e.g., a movement. Moreover, in one embodiment, the graphical actuation can be performed using an optical pen that is moved in relation to a graphical representation of a sound generation system in order to perform an actuation.

In one embodiment, actuation identifier 501 can identify an actuation such as a drawing with an optical pen across a graphical depiction of a turntable (e.g., a drawing along a perimeter, a drawing across the width of the diameter, a drawing in a forward direction, a drawing in a backward direction).

Velocity and direction determiner 503 determines the velocity and the direction of a graphical actuation. In one embodiment, the determination is based upon the movement, by a user, of an optical pen relative to surface based graphics (e.g., turntable, violin, trombone etc.). In one embodiment, the velocity and direction of the actuation can be determined based on the rate at which encoded regions of graphical elements are traversed and which encoded regions of graphical elements are traversed. In one embodiment, this information can be provided as input to a lookup table and/or an algorithm created to correlate movements of an optical pen relative to a surface with corresponding sounds.

Access provider 505 provides access to an identifier of a velocity and a direction of an actuation made by a user. In one embodiment, this information can be provided to a velocity and directionally sensitive sound generation application. In one embodiment, the velocity and directionally sensitive sound generation application can include the aforementioned lookup table and/or algorithm that determine corresponding sounds. In one embodiment, the sound (e.g., a scratching sound with pitch determined by direction and velocity of actuation) can be output by an output component of the optical pen.

Figure 6:
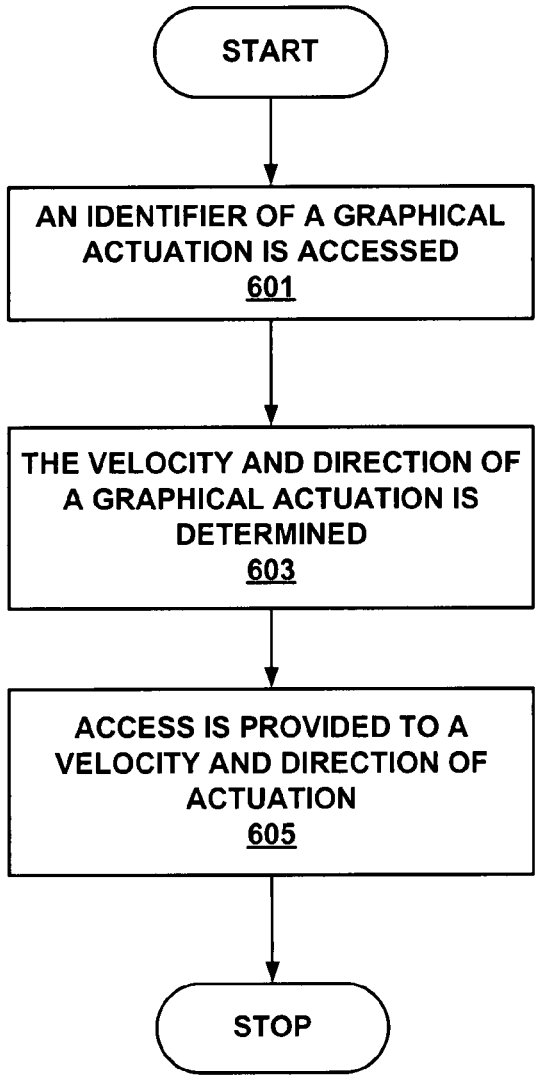
FIG. 6 shows a flowchart of the steps performed in a method for graphical actuation of a velocity and directionally sensitive sound generation application according to one embodiment.

Exemplary Operations of System for Graphical Actuation of a Velocity and Directionally Sensitive Sound Generation Application According to Embodiments FIG. 6 shows a flowchart 600 of the steps performed in a method for graphical actuation of a velocity and directionally sensitive system according to one embodiment. The flowchart includes shows steps representing processes that, in one embodiment, can be carried out by processors and electrical components under the control of computer-readable and computer-executable instructions. Although specific steps are disclosed in the flowcharts, such steps are exemplary. Moreover, embodiments are well suited to performing various other steps or variations of the steps disclosed in the flowcharts. Within various embodiments, it should be appreciated that the steps of the flowcharts can be performed by software, by hardware or by a combination of both.

Referring to FIG. 6, at step 601 an identifier of a graphical actuation is accessed. In one embodiment, an actuation identifier (e.g., 501 in FIG. 5) can be used to access the identifier of a graphical actuation. In one embodiment, the graphical actuation can have a velocity and a direction (e.g., a movement). Moreover, the graphical actuation can be performed using an optical pen that is moved in relation to a graphical representation of a sound generation system in order to perform an actuation.

In one embodiment, actuation identifier 501 can identify an actuation such as a drawing with an optical pen across a graphical depiction of a turntable (e.g., a drawing along a perimeter, a drawing across the width of the diameter, a drawing in a forward direction, a drawing in a backward direction).

At step 603, the velocity and direction of a graphical actuation is determined. In one embodiment, a velocity and direction determiner (e.g., 503 in FIG. 5) can be used to determine the velocity and the direction of a graphical actuation. In one embodiment, the determination is based upon the movement, by a user, of an optical pen relative to a graphical representation of a sound generation system. In one embodiment, the velocity and direction of the actuation can be determined based on the rate at which graphical elements are selected and which graphical elements are selected. In one embodiment, this information can be provided as input to a lookup table or algorithm to determine corresponding sounds.

At step 605, access is provided to an identifier of a velocity and a direction of an actuation. In one embodiment, an access provider (e.g., 505 in FIG. 5) can be used to provide access to an identifier of a velocity and a direction of an actuation made by a user. In one embodiment, this information can be provided to a velocity and directionally sensitive sound generation application. In one embodiment, the velocity and directionally sensitive sound generation application can include the aforementioned lookup table and/or algorithm that determine corresponding sounds. In one embodiment, the sound (e.g., a scratching sound with pitch determined by direction and velocity of actuation) can be output by an output component of optical pen.

In accordance with exemplary embodiments thereof, methods and systems for graphical actuation of a velocity and directionally sensitive sound generation application are disclosed. An identifier of a graphical element or elements that is traversed is received wherein the graphical element or elements are located on a coded surface. In one embodiment, the traversal has a velocity and a direction. Moreover, the traversal can be performed with an optical pen on a graphical representation of a sound generation system. The velocity and the direction of the traversal are determined and access is provided to an identifier of the velocity and the direction of the traversal for actuation of the velocity and directionally sensitive sound generation system.

Embodiments of the present invention are thus described. While the present invention has been described in particular embodiments, it should be appreciated that the present invention should not be construed as limited by such embodiments, but rather construed according to the claims listed below.

What is claimed is:

1. A device comprising:

an optical detector;

a processor coupled to said optical detector; and a memory coupled to said processor, said memory unit containing instructions that when executed implement a method comprising:

receiving an identifier of a graphical actuation of sound that has a velocity and a direction that is performed with an optical pen on a graphical representation of a sound generation system that is drawn with a marking device;

determining said velocity and said direction of said graphical actuation on said graphical representation of a sound generation system; and outputting an identifier of said velocity and said direction.

2. The device of claim 1 wherein a graphical representation of said sound generation system includes sound control components that are printed on a coded surface.

3. The device of claim 1 wherein a graphical representation of said sound generation system includes sound control components that are user drawn on a coded surface.

4. The device of claim 1 wherein said selection is made using an optical pen.

5. The device of claim 1 wherein a pitch, volume or other characteristic of a sound is based on a direction of movement of an optical pen across a surface of said graphical representation of said sound generation system.

6. The device of claim 1 wherein said direction includes along a perimeter, across the width of the diameter, forward and backward.

7. The device of claim 1 wherein said device comprises a velocity and directionally sensitive sound application that produces sounds that include turntable, violin, cello and trombone sounds.

* * * * *